US006116183A

United States Patent [19]

Crow et al.

[11] Patent Number: 6,116,183

[45] Date of Patent: Sep. 12, 2000

[54] POSITIVELY LOCKING BOAT SEAT AND METHOD FOR MAKING THE SAME

[75] Inventors: Robert S. Crow, Grand Rapids; John A. Holtforth, Lake Odessa; Clifton J. Ratza, Grand Rapids, all of Mich.

[73] Assignee: Attwood Corporation, Lowell, Mich.

[21] Appl. No.: 09/164,696

[22] Filed: Oct. 1, 1998

[51] Int. Cl.[7] ..... B63B 17/00

[52] U.S. Cl. ..... 114/363; 297/344.22; 297/451.5

[58] Field of Search ..... 114/363; 248/125.8, 248/159, 408, 409, 410; 297/344.22, 344.18, 451.5

[56] References Cited

U.S. PATENT DOCUMENTS

| | | |
|---|---|---|
| 320,916 | 6/1885 | Dunlap . |
| D. 367,841 | 3/1996 | Garelick . |
| 2,106,650 | 1/1938 | Owler . |
| 2,312,030 | 2/1943 | Cramer et al. . |
| 2,334,193 | 11/1943 | Hedeen et al. . |
| 3,102,638 | 9/1963 | Saunders . |
| 3,377,966 | 4/1968 | Bates et al. . |
| 3,797,870 | 3/1974 | Beckman . |
| 3,858,834 | 1/1975 | Eimen . |
| 3,910,633 | 10/1975 | Marsh . |
| 3,926,396 | 12/1975 | Hall et al. . |
| 3,975,050 | 8/1976 | McKee . |
| 3,979,099 | 9/1976 | Strang . |
| 4,058,282 | 11/1977 | Wahls . |
| 4,097,016 | 6/1978 | Petrucci . |
| 4,227,670 | 10/1980 | Vander Burgh et al. . |
| 4,231,539 | 11/1980 | Sandham . |
| 4,234,989 | 11/1980 | Pearcy . |
| 4,518,139 | 5/1985 | Barfell . |
| 4,566,734 | 1/1986 | Bruner . |
| 4,587,921 | 5/1986 | Currey . |
| 4,655,632 | 4/1987 | Smith . |
| 4,700,921 | 10/1987 | Holbrook . |
| 4,709,649 | 12/1987 | Wann . |
| 4,721,332 | 1/1988 | Sturman . |
| 4,775,187 | 10/1988 | Herr . |
| 4,879,963 | 11/1989 | Dionne . |
| 4,893,850 | 1/1990 | Mizusawa . |
| 4,901,968 | 2/1990 | Ellis et al. . |
| 4,928,620 | 5/1990 | Currey . |
| 4,945,853 | 8/1990 | Lathers . |
| 4,977,848 | 12/1990 | Currey . |
| 5,383,644 | 1/1995 | Huse . |
| 5,385,323 | 1/1995 | Garelick . |
| 5,431,362 | 7/1995 | Carnahan et al. . |
| 5,482,354 | 1/1996 | Gryp . |
| 5,497,965 | 3/1996 | Mathieu, Jr. . |
| 5,639,059 | 6/1997 | Nash . |
| 5,733,006 | 3/1998 | Woods . |
| 5,746,152 | 5/1998 | Huse . |
| 5,775,251 | 7/1998 | Morningstar . |
| 5,784,983 | 7/1998 | Stegall . |

OTHER PUBLICATIONS

Springfield Marine Co.; 1993 Marine Products Catalog; pp. 18–23; Spring–Lock™, Taper–Lock™, and Kingpin™pedestal systems.

*Primary Examiner*—S. Joseph Morano
*Assistant Examiner*—Ajay Vasudeva
*Attorney, Agent, or Firm*—Price, Henveld, Cooper, DeWitt & Litton

[57] ABSTRACT

A pedestal seat assembly for supporting a boat seat thereon includes first and second self-biasing locking mechanisms for restricting rotational and longitudinal movement of the boat seat. A base is configured for mounting to a supporting surface and includes a mounting socket therein. A pedestal or extension has its lower end mounted within the socket of the base. The first self-biasing locking mechanism is mounted within the extension and releasably interconnects the extension and the base, such that the extension is restricted from rotational and longitudinal movement within the base. A seat mount has an upper portion configured to fixedly attach a seat thereto, and a lower portion configured to rotatably mount within the upper end of the extension. The lower end of the seat mount can alternatively be mounted within the socket of the base. The second self-biasing locking mechanism is mounted within the lower portion of the seat mount and releasably interconnects the extension or base such that the seat mount is restricted from rotational and longitudinal movement.

40 Claims, 7 Drawing Sheets

POSITIVELY LOCKING BOAT SEAT AND METHOD FOR MAKING THE SAME

BACKGROUND OF THE INVENTION

The present invention relates to boat seats, and more specifically to a pedestal type of boat seat having self-biasing locking mechanisms provided to automatically lock the boat seat in a predetermined forwardly facing rotational direction, and a method for making the same.

Recreational boating has prompted the need for many configurations and styles of boat seating. Many configurations have incorporated a pedestal attachment, thus allowing the user to be elevated well above the deck of the boat. Still further configurations have incorporated the concept of being able to use the seat itself either with or without the pedestal, as well as the concept of locking the seat from rotational movement. In addition, safety regulations have made it necessary to provide a driver's seat configuration that positively locks the seat from rotational movement, such that the seat is locked in a forward facing position relative to the bow of the boat. To be suitable for such applications, the boat seat pedestal must allow the user free rotational mobility, yet provide positive locking in a forward facing position. The boat seat pedestal should be sufficiently resilient, and allow for economical manufacture.

Another problem sometime encountered with present boat seat pedestals is that current designs are not adaptable to various configuration requirements. Current boat seat pedestals are normally designed with only one particular application configuration.

SUMMARY OF THE INVENTION

One aspect of the present invention is to provide a locking pedestal seat assembly for recreational boats and the like, comprising a seat mount shaped to support a seat member thereon, and a rigid extension having an upper end thereof connected with the seat mount and a laterally extending lock member positioned adjacent the lower end thereof. The pedestal seat assembly includes a two-part locking base configured to mount the extension and the seat mount at a variety of different locations in an associated boat. The base includes a base plate shaped to be mounted on a surface of a boat in one of a plurality of different rotational positions, and includes a first rotational register and a centrally positioned socket defined by an enclosed sidewall with a lock aperture which extends therethrough, and is shaped to receive a portion of the lock member therein. The base also includes an insert, having a sidewall with an interior surface shaped to closely receive the lower end of the extension therein, and an exterior surface shaped to be closely received in the socket of the base plate. The insert includes a second rotational register shaped to engage the first rotational register, and rotationally lock the base and the insert members together in one of a plurality of different predetermined positions. The insert has at least two knock-out windows extending through the sidewall thereof in a marginally spaced apart relationship, and shaped to receive a portion of the lock member therein, with associated knock-out plugs enclosing at least a major portion of the knock-out windows to prevent engagement with the lock member. The insert is received in the socket in one of a plurality of different predetermined rotational positions, with engagement between the first and second rotational registers aligning the lock aperture in the base with one of the knock-out windows in the insert, such that removal of the knock-out plug associated with the one knock-out window forms an assembled lock aperture in the sidewalls of the insert and the base in which the lock member is received to lock the seat mount in a predetermined rotational position and prevent inadvertent dislodgment of the extension from the base.

Another aspect of the present invention is a pedestal seat assembly for recreational boats and the like, comprising a seat mount shaped to support a seat member thereon, and a rigid extension having an upper end thereof connected with the seat mount. The seat assembly includes a base configured to mount the seat assembly at a variety of different locations in an associated boat, and includes a centrally positioned socket shaped to closely receive the lower end of the extension therein. The base has a lower surface thereof shaped for abutting support on the surface of the boat, with a predetermined marginal edge defined by a first closed shape adapted to mount the base plate at a first location in the boat, and a straight rib extending between spaced apart points on the marginal edge. The rib provides an auxiliary edge and guide along which the base plate can be severed to define a second closed shape, different from the first closed shape, so as to mount the base at a second location in the boat.

Yet another aspect of the present invention is a pedestal seat assembly for recreational boats and the like, comprising a base shaped to be mounted on a surface of an associated boat, and including a centrally positioned socket, and an uppermost bearing support surface. A rigid attachment plate is provided to support and retain a seat member thereon. A hub assembly is provided for removably mounting the seat on the base, and includes a rigid support tube fixedly connected with a central portion of the attachment plate and depending therefrom. A bearing sleeve has an interior surface thereof shaped to closely receive the support tube therein, and an exterior surface defining a stem adjacent the lower portion thereof shaped for close pivotal reception in the socket of the base, and a radially outwardly protruding bearing ledge adjacent an upper portion thereof shaped to abuttingly engage the bearing support surface on the base to securely yet removably retain the seat mount in the base.

Yet another aspect of the present invention is a pedestal seat assembly for supporting a boat seat thereon in a forwardly facing position, comprising a base configured for mounting to a support surface, and including a mounting socket. The seat assembly also includes a rigid extension having a lower end thereof rotatably mounted within the socket of the base. A first self-biasing locking mechanism is mounted within the extension and releasably interconnects the extension with the base such that the extension is restricted from rotational and longitudinal movement from the forwardly facing position. A seat mount is provided with an upper portion thereof configured to fixedly attach a seat thereto, and a lower portion thereof configured to rotatably mount within the lower end of the extension and alternatively rotatably mount within the socket of the base. A second self-biasing locking mechanism is mounted within the lower portion of the seat mount, and releasably interconnects the extension such that the seat mount is restricted from rotational longitudinal movement from the forwardly facing position.

Yet another aspect of the present invention is a method for making pedestal seat assemblies for recreational boats and the like of the type which include a seat mount, an extension and a base. A lock is provided adjacent the lower end of the extension, and has a laterally extending lock member, to prevent longitudinal dislodgment of the extension and contemporaneously lock the seat mount in a predetermined rotational position. A base plate is provided for mounting on an associated boat surface in one of a plurality of different rotational positions, and includes a centrally positioned socket defined by an enclosed sidewall with a lock aperture which extends laterally therethrough and is shaped to receive a portion of the lock member therein. An insert is provided having a sidewall with an interior surface shaped to closely receive the lower end of the extension therein, and an exterior surface shaped to be closely received in the socket of the base member. The insert includes at least two knock-out windows extending through the sidewall thereof in a marginally spaced apart relationship, and shaped to receive a portion of the lock member therein, with associated knock-out plugs enclosing at least major portions of the knock-out windows to prevent engagement with the lock member. The method includes pressing the insert into the socket in the base and contemporaneously aligning the lock aperture in the base with one of the knock-out windows in the insert, and removing the knock-out plug associated with the one knock-out window to form an assembled two-part base unit with a lock aperture in the sidewalls of the insert and the base in which the lock member is received to lock the seat mount in the predetermined rotational position and prevent inadvertent dislodgment of the extension from the base.

The principal objectives of the present invention are to provide a pedestal boat seat for recreational boats and similar applications, that provides the installer with the ability to adapt the boat pedestal seat into various configurations. Preferably, the boat seat has self-biasing locking mechanisms that provide positive rotational locking of the seat in a preselected direction. In addition, the boat seat pedestal has a base which is adaptable for use within applications that require alternative base configurations. The boat seat also allows the operator to use the boat seat with or without the extension, while still providing the operator with the ability to rotate the seat as well as a positive lock for locking the seat in a particular direction. The boat pedestal seat also has an uncomplicated design, with a related method that results in reduced manufacturing and assembling costs, is efficient in use, and is particularly well adapted for numerous seating configuration requirements prevalent in the boat industry.

These and other features, advantages and objectives of the present invention will be further understood and appreciated by those skilled in the art by reference to the following specification, claims and appended drawings.

DETAILED DESCRIPTION OF PREFERRED EMBODIMENT

Figure 1:
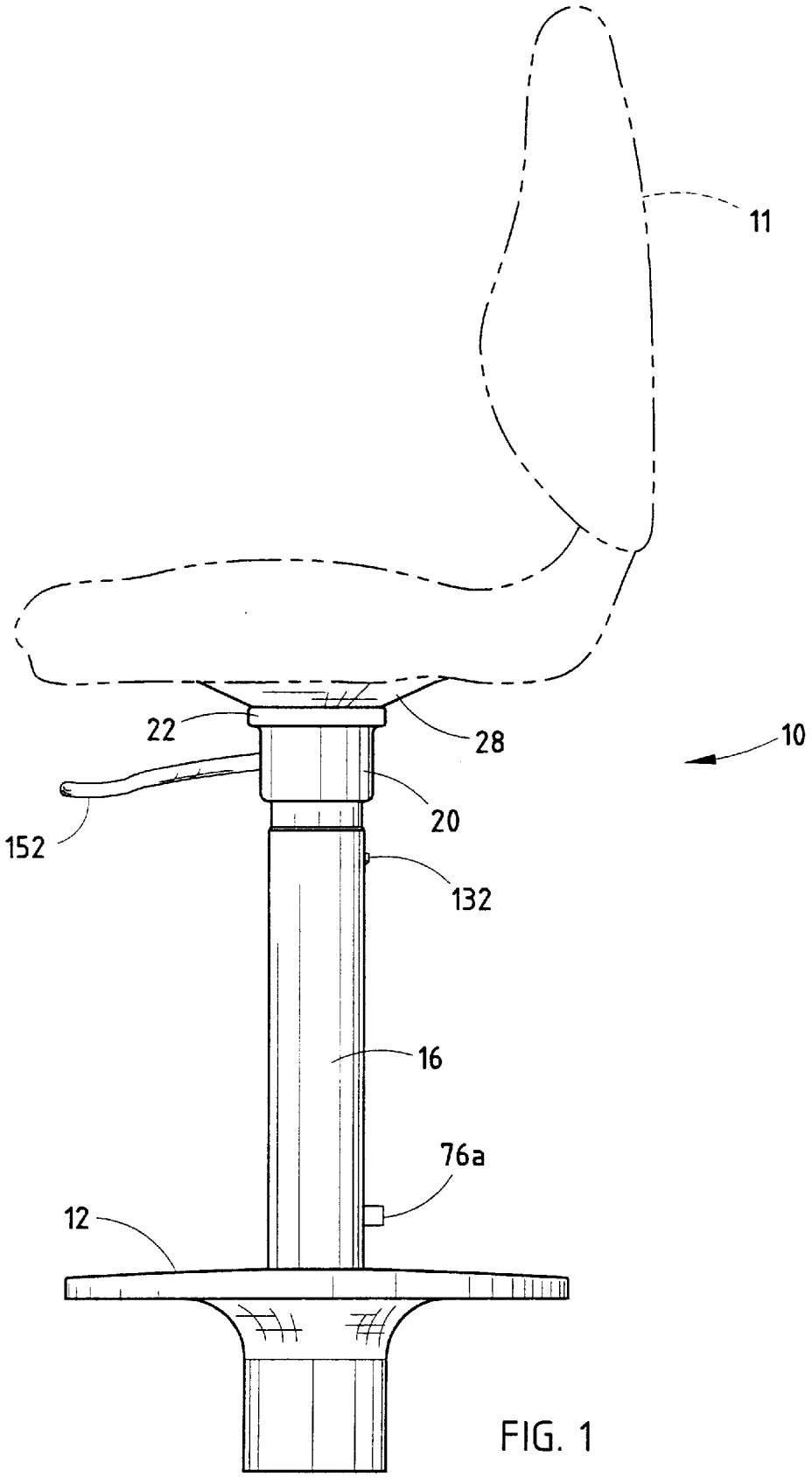
FIG. 1 is a side elevational view of a seat assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a pedestal boat seat assembly embodying the present invention. Boat seat assembly 10 is configured to selectively support a boat seat 11 thereon. Boat seat assembly 10 (FIG. 2) includes a base 12 having a bushing or insert 14, a pedestal or extension 16, an extension locking device or extension lock 18, an upper sleeve 20, a cover ring 22, a seat mount locking device or seat lock 26 and a seat mount 24.

Figure 5:
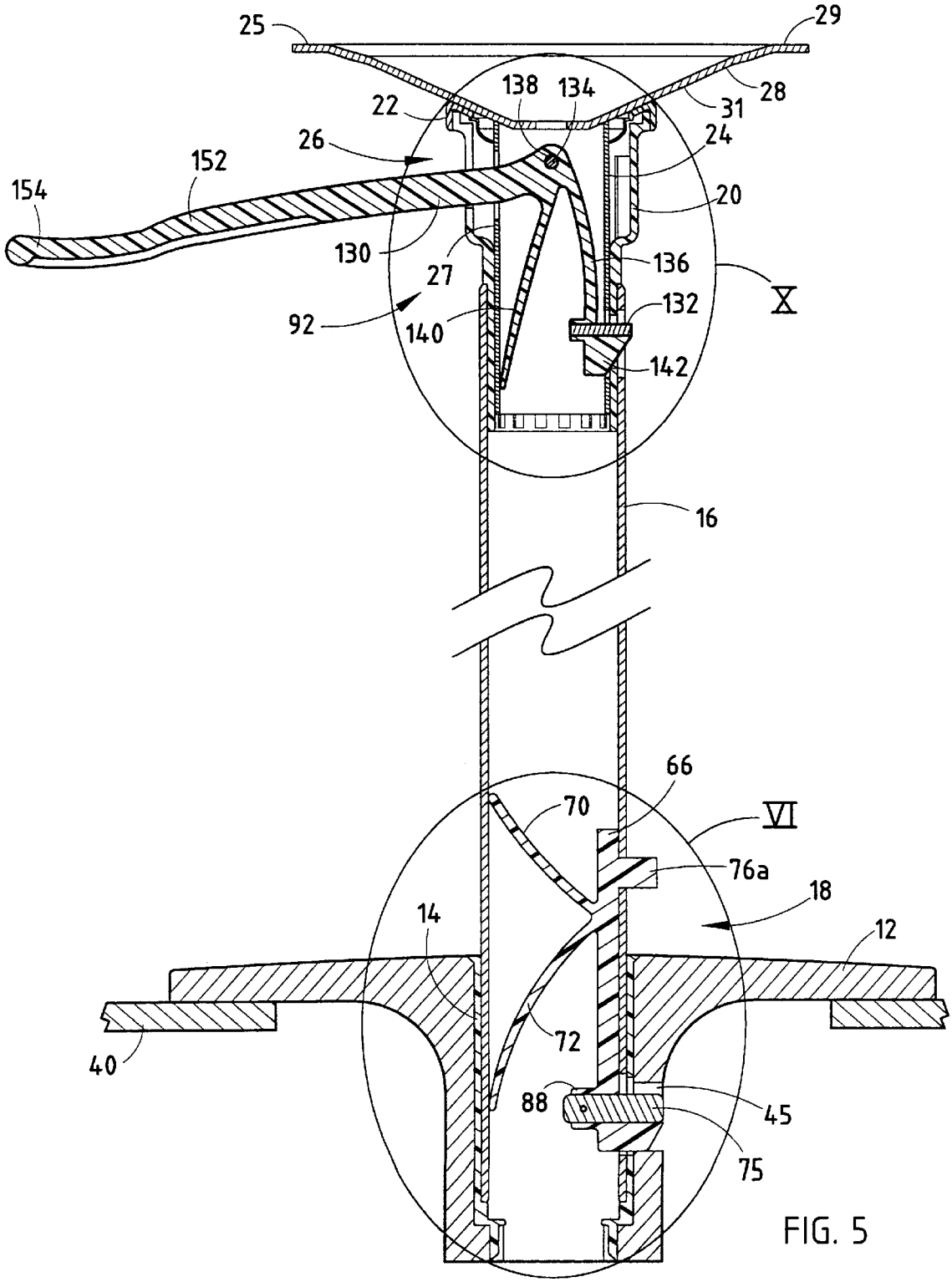
FIG. 5 is a vertical cross-sectional view of the seat assembly.
Figure 6:
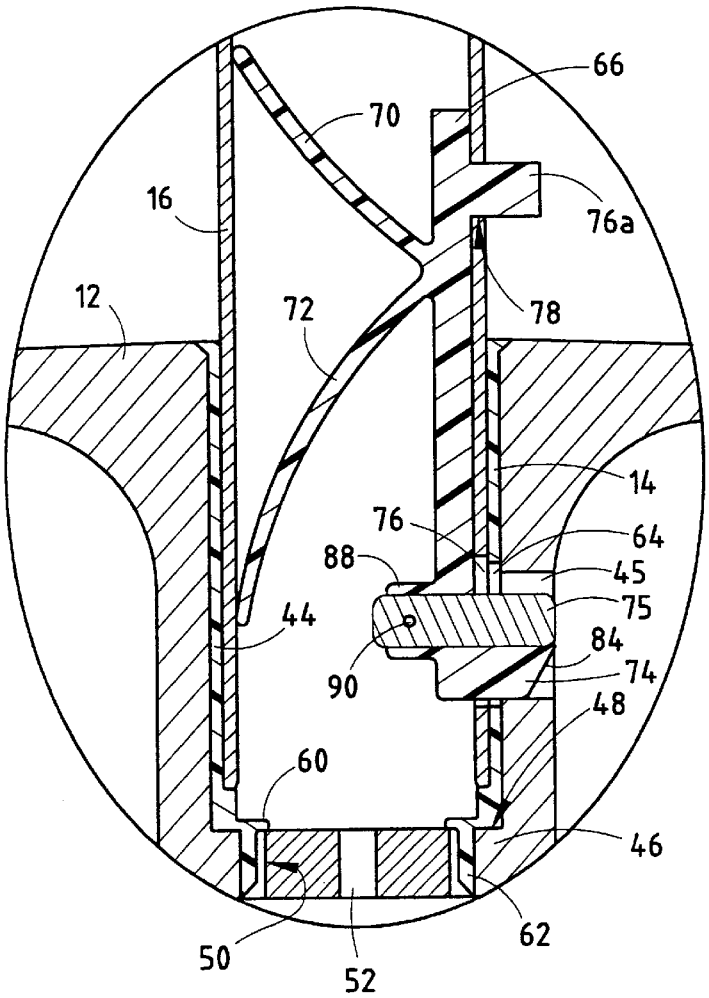
FIG. 6 is an enlarged, fragmentary cross-sectional view of the base member showing an extension locking device and an insert bushing of the seat assembly, taken of area VI, FIG. 5.
Figure 7:
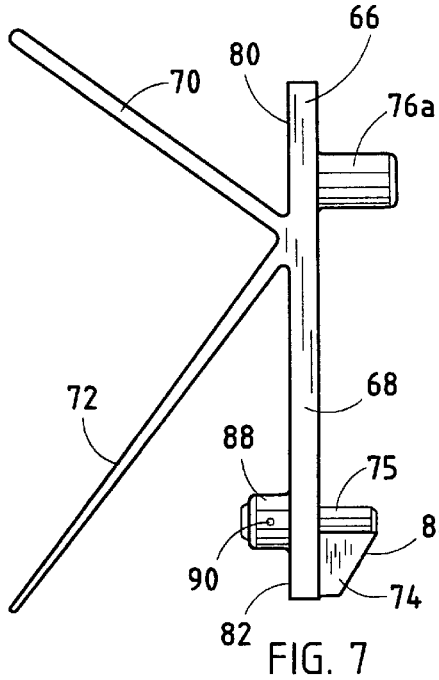
FIG. 7 is a side elevational view of the extension locking device of the seat assembly.
Figure 8:
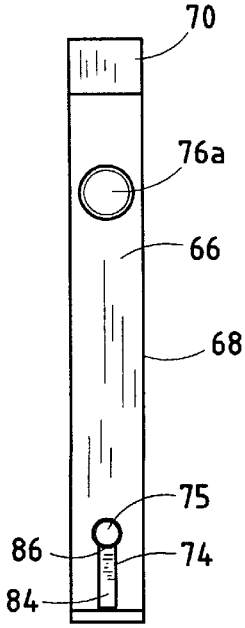
FIG. 8 is a front elevational view of the extension locking device of the seat assembly.

The illustrated base 12 (FIGS. 2 and 3) is constructed of cast aluminum, or other suitable materials. The base 12 includes a base plate 30 that is defined by an upper surface 32 and a lower surface 34. Base plate 30 is provided with a centrally located socket 42 and six hold-down fastener apertures 38 positioned regularly about the periphery of the base 12 in a conventional fashion. The base 12 is affixed to a supporting surface 40 (FIG. 5) by way of screws or bolts (not shown) which are positioned within the fastener apertures 38. The upper surface 32 of base plate 30 includes a bearing support area 32*a* adjacent to and encircling socket 42. The socket 42 is defined by a cylinder sidewall 44 (FIG. 6) and an inwardly extending bottom wall 46. The cylinder sidewall 44 of socket 42 is provided with a lock aperture or slot 45. The cylinder wall 44 of the socket 42 can be provided with additional engagement slots (not shown) spaced regularly about the periphery of the cylinder wall 44. The bottom wall 46 includes an upper surface 48, an inner surface 50, and four longitudinally extending channels 52 formed into the inner surface 50. The channels 52 are positioned regularly about the periphery of the socket 42.

Figure 2:
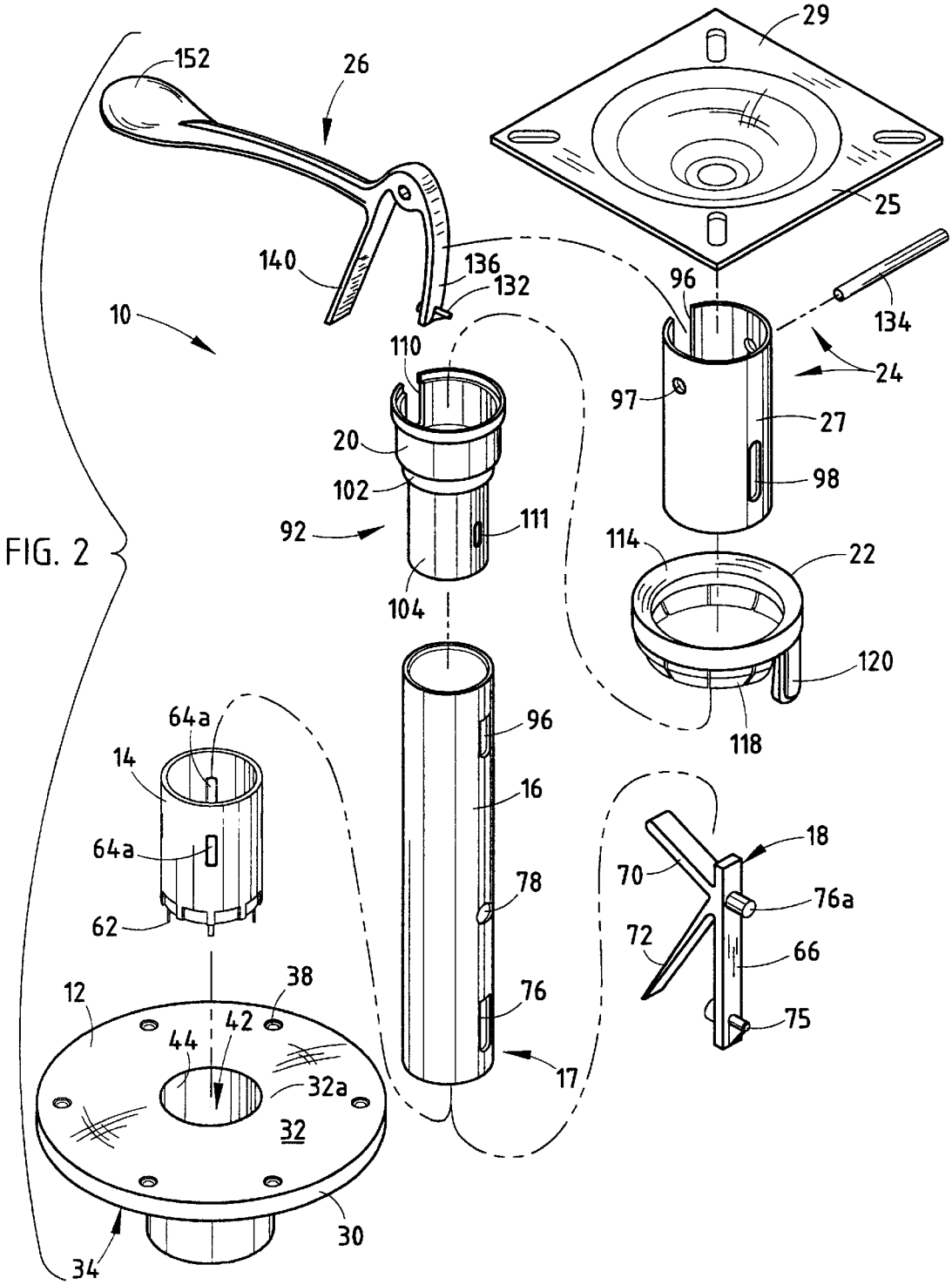
FIG. 2 is an exploded, perspective view of the seat assembly.
Figure 3:
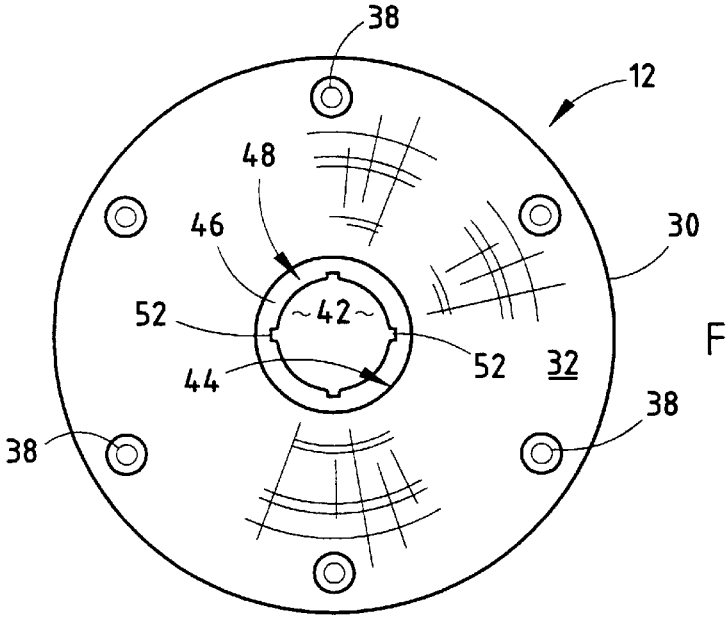
FIG. 3 is a top plan view of a base member of the seat assembly.

Base 12 has a closed plan shape, which in the embodiment illustrated in FIGS. 2–3, is circular. As discussed below, the plan shape of base 12 can be readily modified to accommodate different seat mounting locations in the boat, such as the D-shape shown in FIG. 4*b*.

Figure 4A:
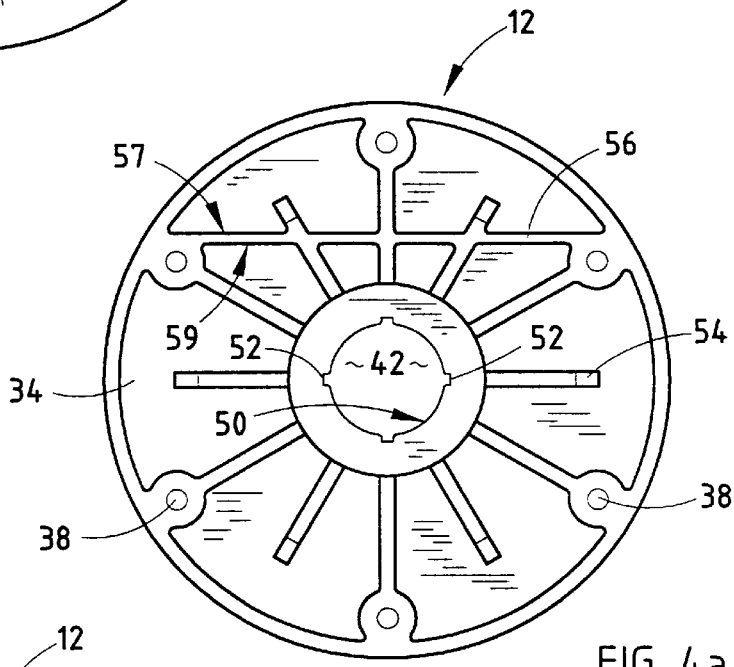
FIG. 4*a* is a bottom plan view of the base member having a full round configuration.
Figure 4B:
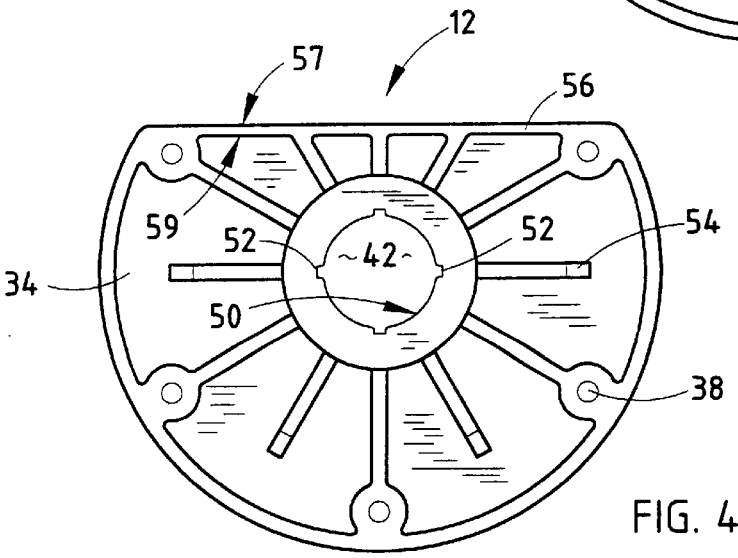
FIG. 4*b* is a bottom plan view of the base member having a partial round configuration.

The lower surface 34 of base 12 (FIG. 4*a*) includes a plurality of downwardly extending reinforcing ribs 54 that extend radially outward from socket 42 in a spoke-like fashion. The lower surface 34 further includes a laterally extending, straight reinforcement rib 56 defined by a first edge 57 and a second edge 59. In the illustrated example, the laterally extending reinforcing rib 56 extends between two opposite fastener apertures 38. The base 12 can be adapted for use either as a fully round base 12 (FIGS. 3 and 4*a*), or as a partially round or D-shaped base 12 (FIG. 4*b*). Base 12 is manufactured in the full round condition (FIGS. 3 and 4*a*), and can be modified to the partial round base 12 configuration (FIG. 4*b*) at the time of installation by simply severing base 12 along the first edge 57 of rib 56. Rib 56 serves as a guide for severing base 12, and also forms an auxiliary edge which matches the marginal edge of the balance of base 12.

Figure 9:
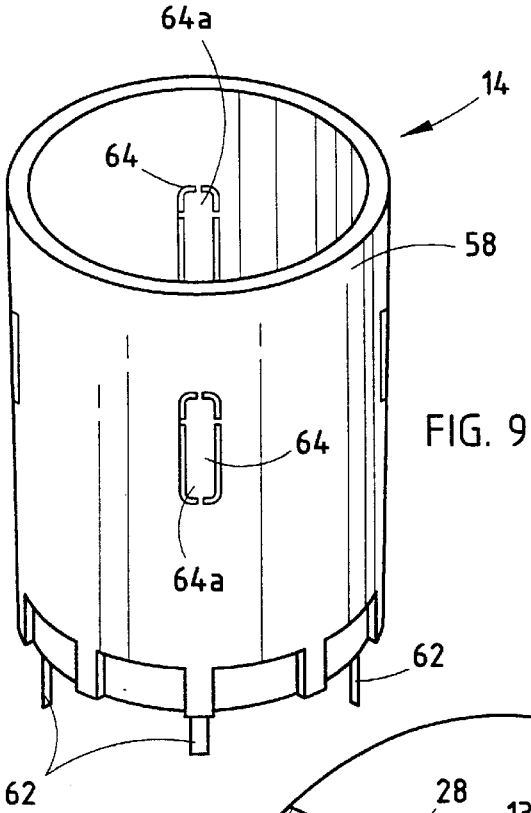
FIG. 9 is a perspective view of a bearing sleeve portion of the seat assembly.

The illustrated insert bushing 14 (FIGS. 2 and 9) is constructed of plastic, or other suitable material. Bushing 14 is cylindrically shaped and includes a tapered cylinder wall 58, an inwardly protruding ledge-shaped bottom wall 60 (FIG. 6), and four spokes or fingers 62 that extend downwardly from lower wall 60. Bushing 14 is provided with a plurality of knock-out windows 64 with associated knock-out plugs 64*a* spaced regularly about the periphery of the cylinder wall 58. The knock-out plugs 64*a* are easily removable from within the cylinder wall 58 so as to provide a corresponding engagement slot 160 within the cylinder wall 58 after the knock-out plug 64*a* has been removed.

In assembly, the insert bushing 14 (FIG. 6) is press fit into socket 42 of base 12 such that the cylinder wall 58 and the bottom wall 60 of the lower bushing 14 are in substantial contact with the inner wall 44 and the bottom wall 46 of the socket 42, respectively. The fingers 62 of the bushing 14 are located so as to be mateably received within the channels 52 of bottom wall 46. The engagement of the fingers 62 within channels 52 prevents rotational movement between the lower bushing 14 and the base 12 and acts as a rotational register to align the knock-out windows 64 of the insert bushing 14 with the lock slot 45. Each base 12 can be adapted to form a locking position in one or more positions, depending upon the application requirements. Consequently, the knock-out windows 64 provide the user with an ability to locate the locking direction of the seat 11 by removing the associated knock-out plug 64*a*. The orientation of the knock-out window 64 is independent of the configuration of the base 12, thereby providing substantial flexibility in using the base 12 in a variety of different positions and applications.

The illustrated pedestal or extension 16 (FIG. 2) is in the shape of a rigid, hollow tube, and may be constructed of aluminum or the like for reduced weight. Extension 16 includes an upper lock aperture 96, a lower lock aperture 76, and an actuator button window 78, as described in detail below.

The extension lock 18 detachably mounts the extension 16 to the base 12. The lock 18 (FIGS. 5–8) includes a one-piece molded plastic first self-biasing locking member 66 and a metal locking pin 75. The first self-biasing locking member 66 includes a body portion 68, an inverted L-shaped side elevation configuration comprising a depending arm 70, a leaf spring arm 72, and an engagement tab 74. The extension 16 is provided with an aperture 76 and an actuator button window 78. The body portion 68 of the first self-biasing locking member 66 is substantially rectangular in shape having the depending arm 70 and the leaf spring arm 72 extending outwardly therefrom. The leaf spring arm 72 is molded integrally with self-biasing locking member 66, and extends from the medial portion of body portion 68 at an angle so as to engage the interior portion of the extension 16. The leaf spring arm 72 is in the nature of a leaf spring, and urges an actuator button outwardly towards its normally locked position within the actuator button window 78. The actuator button 76*a* is positioned at a medial portion of the depending arm 70 and extends from body portion 68 substantially opposite to that of depending arm 70 and leaf spring arm 72. The body portion 68 has a first end 80 and a second end 82. The engagement tab 74 extends outwardly from the body portion 68 of the first self-biasing locking member 66 substantially opposite to the depending arm 70 and the leaf spring arm 72. The engagement tab 74 includes a forwardly and downwardly facing angled ramp 84, and an upwardly disposed rounded seating surface 86. An integrally molded seating socket 88 is molded on an opposite side of the body portion 68 of the first self-biasing locking member 66 from that of the engagement tab 74. The lock member or pin 75 is positioned within socket 88 and extends through body portion 68 of the first self-biasing locking member 66 such that the locking pin 75 is seated within the rounded seating surface 86 of the locking tab 74. A pin 90 extends laterally through socket 88 and locking pin 75 thereby securing locking pin 75 within socket 88.

In assembly, the first self-biasing locking member 66 is positioned within the interior of extension 16 such that the depending arm 70 and the leaf spring arm 72 are in contact with the interior of extension 16. The leaf spring arm 72 biases the actuator button 76*a* into engagement within the the actuator button window 78 of pedestal 16 and the engagement tab 74 and the locking pin 75 to engagement within the lower lock aperture 76 of extension 16. The angled ramp 84 serves to facilitate insertion of the lock 18 into the interior of the extension 16 during assembly. The angular ramp 84 also serves to facilitate the insertion of the extension 16 into engagement within the socket 42 of base 12.

In operation, the user can withdraw the locking pin 75 and locking tab 74 from engagement within the lock aperture 45 of base 12 by providing inward pressure upon the actuator button 76*a* thereby resiliently deforming the leaf spring arms 70 and 72 and counteracting the biasing force provided by the same. By removing the locking tab 74 and the locking pin 75 from engagement within the aperture 45 of base 12, the operator may rotate extension 16 within socket 42 of base 12 and remove extension 16 from longitudinal engagement within the socket 42 of base 12. The metal construction of locking pin 75 greatly reduces wear between the self-biasing locking member 66 and the base 12.

The boat seat support 10 (FIGS. 2 and 5) further includes a hub assembly 92. The hub assembly 92 includes bearing sleeve 20, cover ring 22, seat lock 26, and seat mount 24. The seat mount 24 includes a rigid attachment plate 25 and a rigid support tube 27. Attachment plate 25 is defined by a top surface 29 and a bottom surface 31, and is configured to attachably receive a boat seat 11 on top surface 29. The support tube 27 is fixedly attached to the bottom surface 31 of the attachment plate 25 and extends downwardly therefrom. The illustrated support tube 27 is welded to the attachment plate 25, however, other suitable means for fixed attachment may be appropriate. The support tube 27 is provided with a vertically elongated notch or window 96, a pair of oppositely disposed apertures 97 and an engagement slot 98. The engagement slot 98 is located within the support tube 27 substantially opposite to that of window 96.

Figure 14:
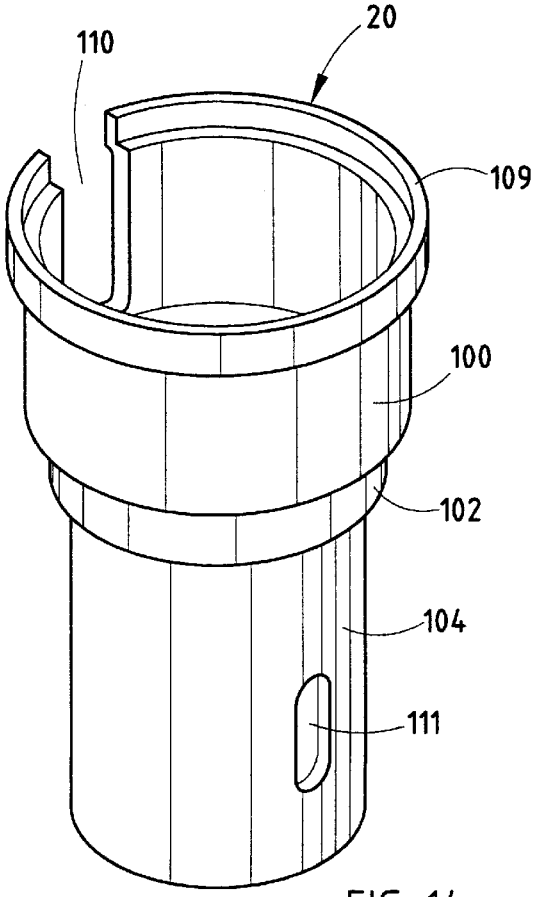
FIG. 14 is a perspective view of the sleeve bearing portion of the seat assembly.
Figure 15:
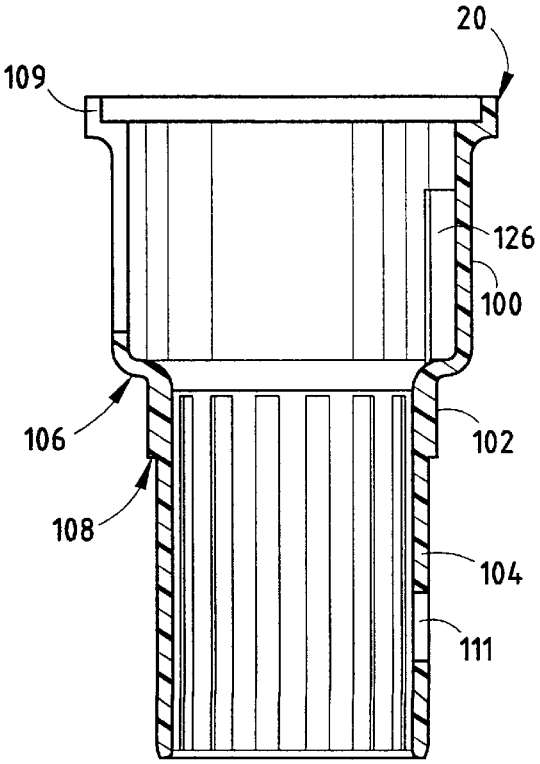
FIG. 15 is a cross-sectional view of the sleeve bearing.

The bearing sleeve 20 (FIGS. 14 and 15) is provided with a first step portion 100, a second step portion 102, and a third step portion 104 each having a different radius. An annular step 106 divides first step portion 100 and second step portion 102. An annular step 108 divides second step portion 102 and third step portion 104. The first step portion 100 of the bearing sleeve 20 is provided with a pair of inwardly projecting tabs 126. The second step portion 102 of bearing sleeve 20 is configured so as to be pivotally received within the lower bushing 14. The third step portion or stem 104 of the bearing sleeve 20 is configured so as to be pivotally received within extension 16. The bearing sleeve 20 further includes an annular flange 109, a vertically elongated window or notch 110, and an engagement slot 111. The window 110 of the bearing sleeve 20 corresponds in size and shape to the window 96 of support tube 27. The engagement slot 111 of the bearing sleeve 20 corresponds in size and shape to the engagement slot 98 of the support tube 27.

Figure 12:
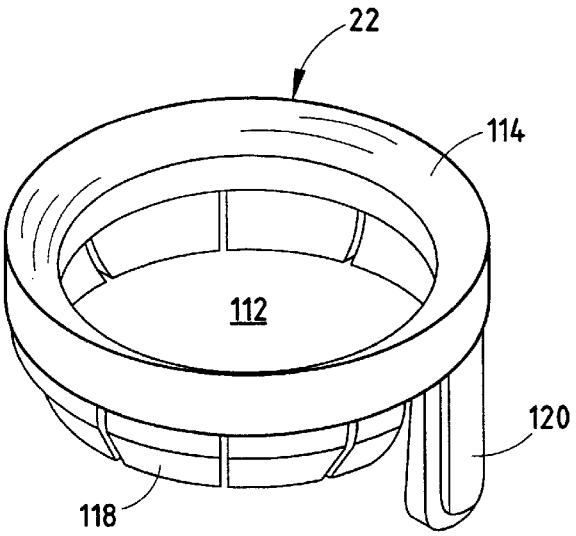
FIG. 12 is a perspective view of a cover ring.
Figure 13:
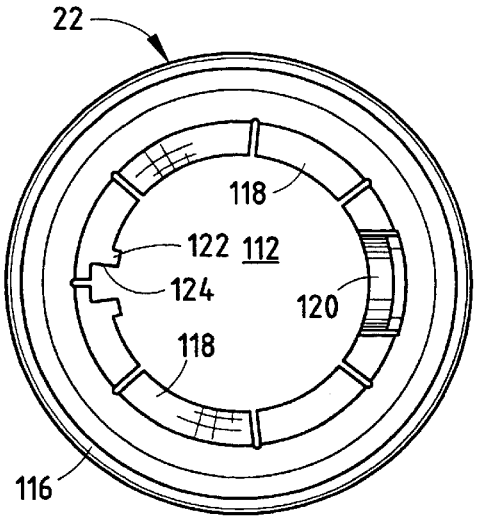
FIG. 13 is a bottom plan view of the cover ring of the seat assembly.

The cover ring 22 (FIGS. 12 and 13) includes a central aperture 112, a top mating surface 114, a step rim 116 in the nature of a tapered collar with a terminal locking edge, a plurality of downwardly and inwardly curved flexible flaps or fingers 118, and a downwardly extending U-shaped tab or arm 120. The aperture 112 is formed by the flexible flaps 118. The step rim 116 extends downwardly from the cover ring 22 and is configured to mateably receive the annular flange 109 of the upper bushing 20 therein. Two of the flexible flaps 118 include inwardly extending locking tabs 122 and clearance recesses 124.

Figure 10:
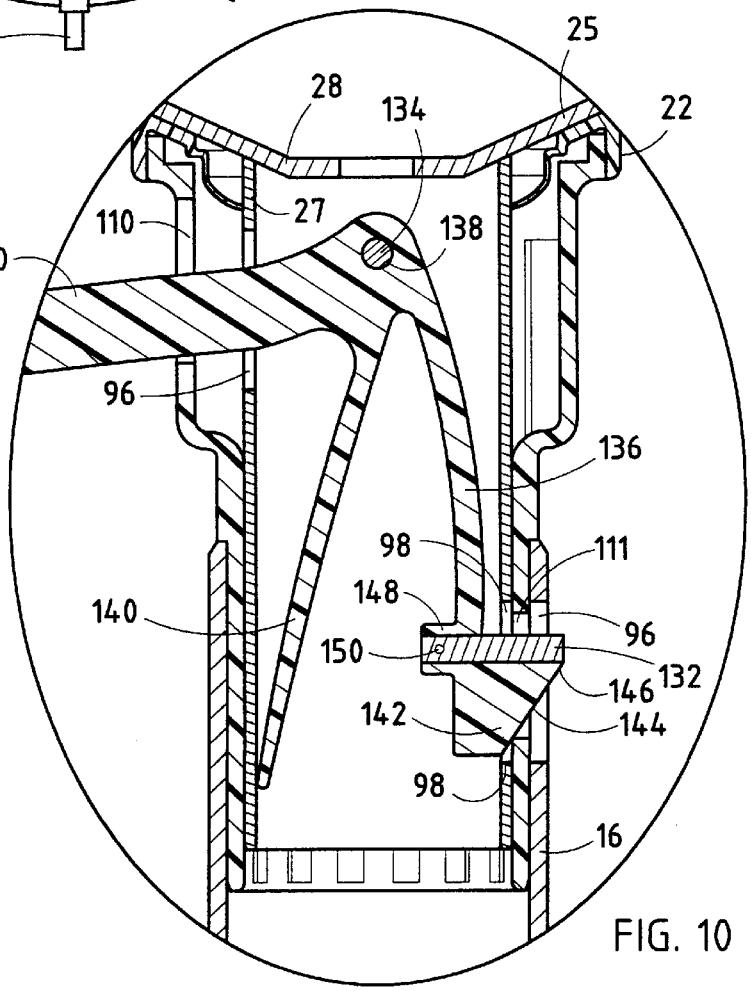
FIG. 10 is an enlarged, fragmentary cross-sectional view of a seat mount locking device and bearing sleeve of the seat assembly, taken of area X, FIG. 5.

In assembly, the cover ring 22 (FIGS. 5 and 10) is positioned about the interior support tube 27 of the seat mount 24, such that the interior support tube 27 extends through the aperture 112 and the top mating surface 114 of the cover ring 22 is seated against the attachment plate 25. The locking tabs 122 of the cover ring 22 are positioned within the window 96 of support tube 27 such that the cover ring 22 is restricted from rotational movement about the support tube 27. The bearing sleeve 20 is positioned about the support tube 27 such that the window 110 and the engagement slot 111 of the bearing sleeve 20 are aligned with the window 96 and the engagement slot 98 of the interior support tube 27, respectively. The annular ring 109 of the bearing sleeve 20 is in mateable contact with the annular flange 116 of the cover ring 22 and is held in position about the interior support tube 27 by a press fit connection between the third step portion 104 of the upper bushing 20 and the support tube 27. The interior tabs 126 of the bearing sleeve 20 mate about the U-shaped arm 20 of the cover ring 22 such that proper alignment of the bearing sleeve 20 with respect to the interior support tube 27 is assured.

Figure 11:
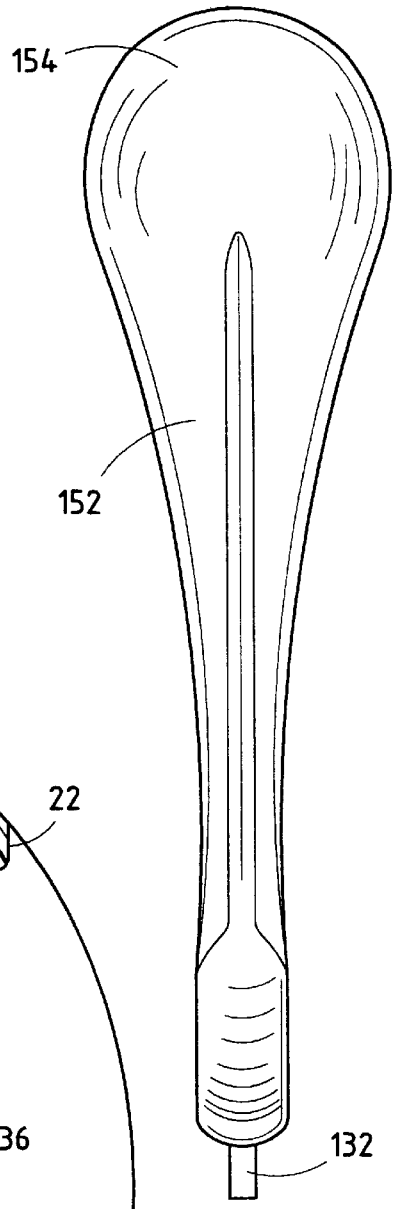
FIG. 11 is an enlarged top plan view of the seat mount locking mechanism of the seat assembly.

The seat lock 26 (FIGS. 5, 10 and 11) is mounted within the interior of support tube 27, and provides rotational and longitudinal locking between the bearing sleeve 20 and the extension 16. The seat lock 26 includes a one-piece molded plastic second self-biasing locking member 130, a metal locking pin 132, and a pivot pin 134. The second self-biasing locking member 130 includes an integrally molded depending arm 136 that extends downwardly from a pivot point 138, and an integrally molded leaf spring arm 140. The depending arm 136 includes a distally located integrally molded engagement tab 142. The engagement tab 142 includes an angled ramp 144 and an upwardly disposed concave top surface 146. The depending arm 136 further includes a socket 148 in which the locking pin 132 is mounted such that the locking pin 132 extends through depending arm 136 and is seated within the rounded top surface 146 of the engagement tab 142. A pin 150 extends laterally through the socket 148 and the locking pin 132 thereby securing locking pin 132 within socket 148. The second self-biasing locking member 130 further includes an integrally molded outwardly extending actuator lever or handle 152 having a distally located flanged end 154.

In assembly, the seat lock 26 is held in position by and pivots about a pivot pin 134 which is anchored to the interior support tube 27 through apertures 97. The leaf spring arm 140 extends down interior support tube 27 opposite depending arm 136. The leaf spring arm 140 resiliently biases the locking pin 132 and the engagement tab 142 into engagement within the engagement slot 98 of the support tube 27, the engagement slot 111 of the bearing sleeve 20, and upper lock aperture 96 of extension 16. The actuator handle 152 facilitates manual rotation of the seat lock 26 about pivot pin 134 so as to engage and disengage the locking pin 132 and the engagement tab 142.

In operation, the bearing sleeve 20 can be inserted into the extension 16. In this configuration, the third step portion 104 of the bearing sleeve 20 is rotatably received within the extension 16. Rotation of the seat 11 about the extension 16 will cause the locking pin 132 to automatically lock into the upper lock aperture 96 of extension 16. Alternatively, the bearing sleeve 20 may be received within the insert bushing 14, such that the seat can be mounted directly into the base 12, without use of extension 16. In this application, the second step portion 102 of the bearing sleeve 20 is rotatably received within the insert bushing 14, and the locking pin 132 of the seat lock 26 is received through bushing window 64 and into engagement slot 45 in a manner similar to the locking action of the extension lock device 18, thus locking the bearing sleeve 20 against rotational and longitudinal movement within the insert bushing 14.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A locking pedestal seat assembly for recreational boats, comprising:

a seat mount shaped to support a seat member thereon;

a rigid extension having an upper end thereof connected with said seat mount, and a lower end thereof having a laterally extending lock member to prevent longitudinal dislodgment of said extension and contemporaneously lock said seat mount in a predetermined rotational position; and a two-part locking base assembly configured to mount said extension and said seat mount at a variety of different locations in an associated boat, including:

a base shaped to be mounted on a surface of the boat in one of a plurality of different rotational positions, and including a first rotational register, and a centrally positioned socket defined by an enclosed sidewall with a lock aperture which extends laterally therethrough and is shaped to receive a portion of said lock member therein; and an insert having a sidewall with an interior surface shaped to closely receive the lower end of said extension therein, and an exterior surface shaped to be closely received in the socket of said base member; said insert including a second rotational register shaped to engage said first rotational register and rotationally lock said base and insert together in one of a plurality of different predetermined positions, and at least two knock-out windows extending through the sidewall thereof in a marginally spaced apart relationship, and shaped to receive a portion of said lock member therein, with associated knock-out plugs enclosing at least major portions of said knock-out windows to prevent engagement with said lock member, whereby said insert is received in said socket in one of said plurality of different predetermined rotational positions, with engagement between said first and second rotational registers aligning the lock aperture in said base with one of the knock-out windows in said insert, such that removal of the knock-out plug associated with said one knock-out window forms an assembled lock aperture in the sidewalls of said insert and said base in which said lock member is received to lock said seat mount in said predetermined rotational position and prevent inadvertent dislodgment of said extension from said base.

2. A seat assembly as set forth in claim 1, wherein:

said base includes a base plate with a lower surface thereof shaped for abutting support on the surface of the boat; said lower surface of said base plate having a predetermined marginal edge defining a first closed shape adapted to mount said base plate at a first location in the boat, and a straight rib extending between spaced apart points on said marginal edge, and providing an auxiliary edge and guide along which said base plate can be severed to define a second closed shape, different from said first closed shape, adapted to mount said base at a second location in the boat.

3. A seat assembly as set forth in claim 2, wherein:

said base plate includes a plurality of normally vertically disposed apertures spaced along the marginal edge thereof shaped to receive fasteners therein for attaching said base to the boat surface.

4. A seat assembly as set forth in claim 3, wherein:

said base plate has a circular plan shape defining said first closed shape; and said second closed shape is partially round.

5. A seat assembly as set forth in claim 4, wherein:

said second closed shape is D-shaped.

6. A seat assembly as set forth in claim 5, wherein:

said second rotational register comprises a plurality of fingers protruding normally downwardly from a lower end of said insert; and said first rotational register comprises a plurality of apertures disposed in a normally lower portion of said base sidewall, and shaped to receive said fingers therein.

7. A seat assembly as set forth in claim 6, wherein:

said insert includes four of said knock-out windows spaced substantially mutually equi-distantly in said sidewall thereof.

8. A seat assembly as set forth in claim 7, wherein:

said exterior surface of said insert is tapered to provide a secure press fit in said socket.

9. A seat assembly as set forth in claim 8, wherein:

said insert includes a radially inwardly protruding ledge shaped to engage and abuttingly support a lowermost end edge of said extension.

10. A seat assembly as set forth in claim 9, wherein:

said socket includes a radially inwardly extending bottom ledge disposed adjacent a lowermost end of said base sidewall; and said insert includes a bottom edge abuttingly engaging the bottom ledge of said base and supporting said insert in said base.

11. A seat assembly as set forth in claim 10, wherein:

said base includes a bearing support surface encircling said socket along an uppermost surface thereof.

12. A seat assembly as set forth in claim 11, wherein:

said seat mount includes a hub assembly, comprising:

a rigid attachment plate shaped to support and retain the seat member thereon;

a rigid support tube fixedly connected with a central portion of said attachment plate and depending therefrom; and a bearing sleeve having an interior surface shaped to closely receive said support tube therein, and an exterior surface defining a stem adjacent a lower portion thereof shaped for close pivotal reception in the socket of said base, and a radially outwardly protruding bearing ledge adjacent an upper portion thereof shaped to abuttingly engage the bearing support surface on said base to securely yet removably retain said seat mount in said base.

13. A seat assembly as set forth in claim 12, wherein:

said hub assembly includes a cover ring positioned about said support tube and extending axially between said attachment plate and said bearing sleeve.

14. A seat assembly as set forth in claim 13, wherein:

said cover ring includes a radially inwardly extending locking edge defined by a flexibly resilient tapered collar portion with a plurality of radially extending slits therethrough defining flaps which deflect and frictionally engage the outer surface of said support tube to retain the same thereon without separate fasteners.

15. A pedestal seat assembly for recreational boats, comprising:

a seat mount shaped to support a seat member thereon;

a rigid extension having a lower end thereof, and an upper end thereof connected with said seat mount; and a base configured to mount said seat assembly at a variety of different locations in an associated boat in one of a plurality of different rotational positions, including a centrally positioned socket shaped to closely receive the lower end of said extension therein, and a base plate with a lower surface thereof shaped for abutting support on the surface of the boat; said lower surface of said base plate having a predetermined marginal edge defining a first closed shape adapted to mount said base plate at a first location in the boat, and a straight rib extending between spaced apart points on said marginal edge, and providing an auxiliary edge and guide along which said base plate can be severed to define a second closed shape, different from said first closed shape, adapted to mount said base at a second location in the boat.

16. A seat assembly as set forth in claim 15, wherein:

said base plate has a circular plan shape defining said first closed shape, and said second closed shape is partially round.

17. A seat assembly as set forth in claim 16, wherein:

said second closed shape is D-shaped.

18. A seat assembly as set forth in claim 17, wherein:

said base plate includes a plurality of normally vertically dispose apertures spaced along the marginal edge thereof shaped to receive fasteners therein for attaching said base to the boat surface.

19. A seat assembly as set forth in claim 18, wherein:

said extension has a laterally extending lock member disposed adjacent the lower end thereof to prevent longitudinal dislodgment of said extension and contemporaneously lock said seat mount in a predetermined rotational position; and said base comprises a two-part locking base assembly configured to mount said extension and said seat mount at a variety of different locations in an associated boat, including:

a base plate shaped to be mounted on a surface of the boat in one of a plurality of different rotational positions, and including a first rotational register, and wherein said socket is defined by an enclosed sidewall with a lock aperture which extends laterally therethrough and is shaped to receive a portion of said lock member therein; and an insert having a sidewall with an interior surface shaped to closely receive the lower end of said extension therein, and an exterior surface shaped to be closely received in the socket of said base member; said insert member including a second rotational register shaped to engage said first rotational register and rotationally lock said base and insert members together in one of a plurality of different predetermined positions, and at least two knock-out windows extending through the sidewall thereof in a marginally spaced apart relationship, and shaped to receive a portion of said lock member therein, with associated knock-out plugs enclosing at least major portions of said knock-out windows to prevent engagement with said lock member, whereby said insert is received in said socket in one of said plurality of different predetermined rotational positions, with engagement between said first and second rotational registers aligning the lock aperture in said base with one of the knock-out windows in said insert, such that removal of the knock-out plug associated with said one knock-out window forms an assembled lock aperture in the sidewalls of said insert and said base in which said lock member is received to lock said seat mount in said predetermined rotational position and prevent inadvertent dislodgment of said extension from said base.

20. A pedestal seat assembly for recreational boats, comprising:

a base shaped to be mounted on a surface of an associated boat, and including a centrally positioned socket, and an uppermost bearing support surface;

a rigid attachment plate shaped to support and retain a seat member thereon; and a hub assembly for removably mounting the seat on said base, including:

a rigid support tube fixedly connected with a central portion of said attachment plate and depending therefrom; and a bearing sleeve having an interior surface shaped to closely receive said support tube therein, and an exterior surface defining a stem adjacent a lower portion thereof shaped for close pivotal reception in the socket of said base, and a radially outwardly protruding bearing ledge adjacent an upper portion thereof shaped to abuttingly engage the bearing support surface on said base to securely yet removably retain said seat mount in said base.

21. A seat assembly as set forth in claim 20, including:

a cover ring positioned about said support tube and extending axially between said attachment plate and said bearing sleeve.

22. A seat assembly as set forth in claim 21, wherein:

said cover ring includes a radially inwardly extending locking edge which frictionally engages the outer surface of said support tube to retain the same thereon without separate fasteners.

23. A seat assembly as set forth in claim 22, wherein:

said locking edge is defined by a flexibly resilient tapered collar portion with a plurality of radially extending slits therethrough which define flaps which deflect and frictionally engage the outer surface of said support tube.

24. A seat assembly as set forth in claim 23, wherein:

said hub assembly includes a lock detachably retaining said seat mount in said base.

25. A seat assembly as set forth in claim 24, wherein:

said base includes a lock aperture disposed laterally in said socket; and said lock includes a radially disposed lock member shaped for selective reception in said lock aperture.

26. A seat assembly as set forth in claim 25, wherein:

said support tube and said bearing sleeve include aligned, laterally extending windows through which said lock member extends.

27. A seat assembly as set forth in claim 26, wherein:

said lock includes a pivoting actuator lever which protrudes laterally outwardly from said hub assembly.

28. A seat assembly as set forth in claim 27, wherein:

said bearing sleeve includes a notch through the upper portion thereof in which said actuator lever is received.

29. A seat assembly as set forth in claim 28, wherein:

said cover ring includes a depending tab which covers that portion of said notch which is not occupied by said actuator lever.

30. A pedestal seat assembly for supporting a boat seat thereon in a forwardly facing position, comprising:

a base configured for mounting to a supporting surface and including a mounting socket;

a rigid extension having an upper end thereof and a lower end thereof rotatably mounted within the socket of said base;

a first self-biasing locking mechanism mounted within said extension, and releasably interconnecting said extension and said base such that said extension is restricted from rotational and longitudinal movement from the forwardly facing position;

a seat mount having an upper portion thereof configured to fixedly attach a seat thereto, and a lower portion thereof configured to rotatably mount with the lower end of said extension and alternatively rotatably mount within the socket of said base; and a second self-biasing locking mechanism mounted within the lower portion of said seat mount and releasably engaging said extension such that said seat mount is restricted from rotational and longitudinal movement from the forwardly facing position.

31. A pedestal seat assembly as set forth in claim 30, wherein:

said first self-biasing locking mechanism includes a depending arm, a leaf spring arm, an engagement tab, and an actuator button, wherein said leaf spring arm is positioned so as to engage an inner wall of said extension and bias said actuator button into engagement within an aperture within said extension and bias said engagement tab into engagement within a first engagement slot within said extension and an engagement slot within said socket.

32. A pedestal seat assembly as set forth in claim 31, including:

a metal locking pin mounted within said first self-biasing locking mechanism such that said pin engages the first engagement slot of said extension.

33. A pedestal seat assembly as set forth in claim 32, wherein:

said second self-biasing locking mechanism includes a depending arm, a leaf spring arm, an engagement tab, a pivot axis, and an actuator lever, wherein said second self-biasing locking mechanism is pivotally fixed within said seat mount by a pivot pin passing through the pivot axis such that said leaf spring arm engages an inner wall of said seat mount biasing said engagement tab into engagement with an engagement slot with said seat mount and a second engagement slot within said extension thus restricting rotational and longitudinal movement of said seat mount within said extension, said actuator handle outwardly extending from a window within said seat mount and positioned such that upward movement of the distal end of said actuator handle causes said engagement tab to disengage said second engagement slot of said extension thus allowing rotational and longitudinal movement of said seat mount within said extension.

34. A pedestal seat assembly as set forth in claim 33, including:

a metal locking pin mounted within said second self-biasing locking mechanism such that said locking pin engages said engagement slot of said seat mount.

35. In a method for making pedestal seat assemblies for recreational boats including a seat mount, an extension and a base, the improvement comprising:

providing a lock adjacent the lower end of the extension having a laterally extending lock member to prevent longitudinal dislodgment of the extension and contemporaneously lock the seat mount in a predetermined rotational position;

providing a base plate shaped to be mounted on a surface of an associated boat in one of a plurality of different rotational positions, and including a centrally positioned socket defined by an enclosed sidewall with a lock aperture which extends laterally therethrough and is shaped to receive a portion of the lock member therein;

providing an insert having a sidewall with an interior surface shaped to closely receive the lower end of said extension therein, and an exterior surface shaped to be closely received in the socket of the base member; the insert member including at least two knock-out windows extending through the sidewall thereof in a marginally spaced apart relationship, and shaped to receive a portion of said lock member therein, with associated knock-out plugs enclosing at least major portions of said knock-out windows to prevent engagement with said lock member;

pressing the insert into the socket in the base and contemporaneously aligning the lock aperture in the base with one of the knock-out windows in the insert; and removing the knock-out plug associated with the one knock-out window to form an assembled two-part base assembly with a lock aperture in the sidewalls of the insert and the base in which the lock member is received to lock the seat mount in the predetermined rotational position and prevent inadvertent dislodgment of the extension from the base.

36. A method as set forth in claim 35, including:

forming the base plate with a lower surface shaped for abutting support on the surface of the boat, and having a predetermined marginal edge defining a first closed shape adapted to mount the base plate at a first location in the boat;

forming a straight rib on the lower surface of the base plate which extends between spaced apart points on the marginal edge thereof, and provides an auxiliary edge and guide along which the base plate can be severed to define a second closed shape, different from the first closed shape, adapted to mount the base plate at a second location in the boat; and severing the base plate along the rib.

37. A method as set forth in claim 36, including:

forming a bearing support surface on the upper surface of the base encircling the socket;

providing a rigid attachment plate shaped to support and retain a seat member thereon;

providing a rigid support tube;

fixedly connecting one end of the support tube with the lower surface of the attachment plate such that the support tube depends therefrom in a substantially perpendicular relationship;

providing a bearing sleeve having an interior surface shaped to closely receive the support tube therein, and an exterior surface defining a stem adjacent a lower portion thereof shaped for close pivotal reception in the socket of the base;

forming a radially outwardly protruding bearing ledge adjacent an upper portion of the bearing sleeve shaped to abuttingly engage the bearing support surface on said base; and pressing the bearing sleeve onto the support tube to define a hub assembly.

38. A method as set forth in claim 37, including:

providing a cover ring shaped to be positioned about the support tube and extend axially between the attachment plate and the bearing sleeve; and pressing the cover ring onto the support tube prior to said bearing sleeve pressing step.

39. A method as set forth in claim 38, including:

forming the cover ring with a radially inwardly extending locking edge which frictionally engages the outer surface of the support tube to retain the same thereon without separate fasteners.

40. A method set forth in claim 38, including:

forming the locking edge with a flexibly resilient tapered collar having a plurality of radially extending slits therethrough which define flaps which deflect and frictionally engage the outer surface of the support tube.

* * * * *